US006315147B1

(12) United States Patent
Bachmeier

(10) Patent No.: US 6,315,147 B1
(45) Date of Patent: Nov. 13, 2001

(54) SEAL CAP FOR PRESSURIZED GAS CONTAINERS

(75) Inventor: Franz Bachmeier, Unterneukirchen (DE)

(73) Assignee: InfraServ GmbH & Co. Gendorf KG (DE)

( * ) Notice: Subject to any disclaimer, the term of this patent is extended or adjusted under 35 U.S.C. 154(b) by 0 days.

(21) Appl. No.: 09/445,334

(22) PCT Filed: Dec. 16, 1997

(86) PCT No.: PCT/EP97/07067

§ 371 Date: Feb. 28, 2000

§ 102(e) Date: Feb. 28, 2000

(87) PCT Pub. No.: WO98/57096

PCT Pub. Date: Dec. 17, 1998

(30) Foreign Application Priority Data

Jun. 9, 1997 (DE) ..... 297 09 989 U

(51) Int. Cl.[7] ..... B65D 45/16

(52) U.S. Cl. ..... 220/325; 220/327; 220/378; 220/203.01; 220/203.04

(58) Field of Search ..... 220/202, 203.04, 220/203.01, 324, 325, 327, 328, 378, 212, 212.5, 315; 137/587

(56) References Cited

U.S. PATENT DOCUMENTS

| | | | | |
|---|---|---|---|---|
| 1,019,732 | * | 3/1912 | Borochow | 220/212.5 X |
| 1,109,828 | * | 9/1914 | Goff . | |
| 1,439,000 | * | 12/1922 | Jacobs . | |
| 1,561,141 | * | 11/1925 | Coughlin | 220/212.5 |
| 1,941,294 | * | 12/1933 | Eck et al. . | |
| 2,195,132 | * | 3/1940 | Nelson . | |
| 2,357,246 | * | 8/1944 | Whitmyer . | |
| 2,465,095 | | 3/1949 | Harvey . | |
| 2,514,976 | * | 7/1950 | Stivin | 220/327 X |
| 2,736,083 | * | 2/1956 | Rogers . | |
| 3,323,541 | | 6/1967 | Schneider, Jr. . | |
| 3,360,155 | * | 12/1967 | Colonna . | |
| 3,387,738 | * | 6/1968 | Kemp | 220/324 X |
| 3,429,476 | * | 2/1969 | Hunter . | |
| 3,441,166 | * | 4/1969 | DeFrees | 220/324 |
| 3,441,656 | * | 4/1969 | Selden | 220/324 |
| 3,468,577 | * | 9/1969 | Winston et al. . | |
| 3,498,493 | * | 3/1970 | Kemp . | |
| 3,615,006 | * | 10/1971 | Freed . | |
| 3,620,408 | * | 11/1971 | Holbrook et al. | 220/202 |
| 3,672,403 | * | 6/1972 | Wilson et al. . | |
| 3,848,768 | * | 11/1974 | Griffin | 220/324 X |

(List continued on next page.)

FOREIGN PATENT DOCUMENTS

| | | | | |
|---|---|---|---|---|
| 856746 | | 2/1952 | (DE) . | |
| 938657 | * | 2/1956 | (DE) | 220/325 |
| 2067736 | | 8/1971 | (FR) . | |
| 575666 | * | 8/1924 | (FR) | 220/325 |
| 1070380 | * | 10/1924 | (FR) | 220/325 |
| 1051706 | * | 1/1954 | (FR) | 220/325 |
| 223335 | * | 10/1924 | (GB) | 220/325 |
| 517754 | * | 2/1940 | (GB) | 220/325 |
| 99768 | * | 6/1961 | (NL) | 220/325 |

*Primary Examiner*—Allan N. Shoap
*Assistant Examiner*—Robin A. Hylton
(74) *Attorney, Agent, or Firm*—Connolly Bove Lodge & Hutz LLP

(57) ABSTRACT

A sealing cap for pressurized gas containers, in particular for 500 kg chlorine containers, has at least two, preferably four, retaining claws, which engage in an existing bead on the pressurized gas container and effect the sealing. The retaining claws are connected to the sealing cap via a rod having a mount, the rod, at the opposite end, having a screw thread with a lock nut. A seal of resistant material is advantageously guided in a groove of the sealing cap. Furthermore, the sealing cap may have a pressure gage, a discharge valve and handles.

8 Claims, 1 Drawing Sheet

U.S. PATENT DOCUMENTS 4,157,146 * 6/1979 Svenson ..... 220/324
4,308,971 * 1/1982 Straub .
4,379,513 * 4/1983 Basterfield et al. .
4,723,573 * 2/1988 Burnett ..... 137/587
5,248,055 * 9/1993 Sanai et al. .
5,501,357 * 3/1996 Fullin ..... 220/325
5,657,892 * 8/1997 Bolli et al. .

* cited by examiner

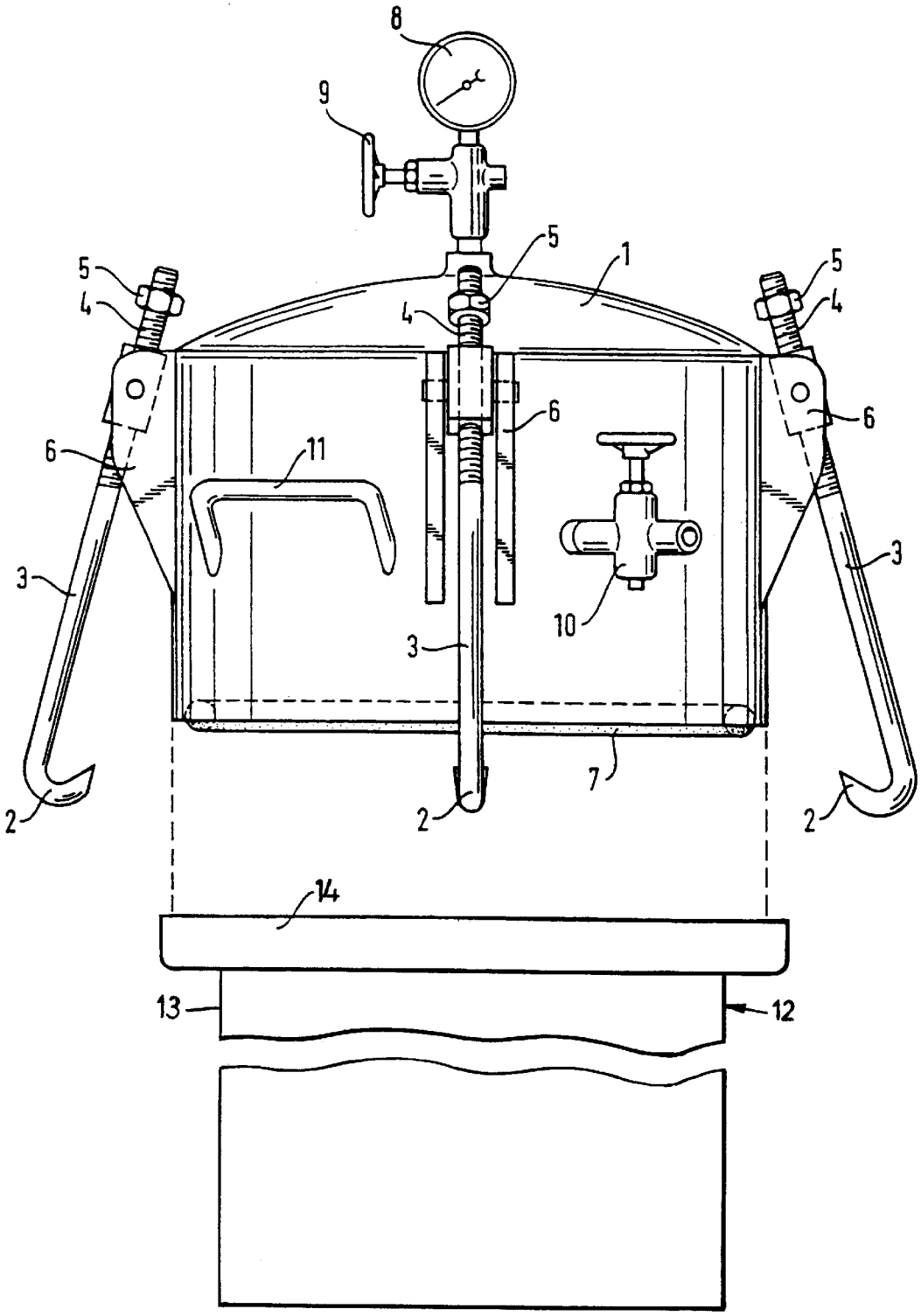
8
9
5
1
5
4
4
5
4
6
6
6
11
3
3
10
3
7
2
2
2
14
13
12

SEAL CAP FOR PRESSURIZED GAS CONTAINERS

Pressurized gas containers are subject to strict safety regulations. Thus, chlorine-cylinder valves must be renewed after three years at the latest. However, experience shows that damage to pressurized chlorine containers, in particular in the valve region, occur again and again. Sealing caps for chlorine cylinders of 50 and 65 kg capacity are commercially available (brochure from SBF Wasser und Umwelt; branch of Preussag Anlagenbau GmbH, 31228 Peine, 4 K-271/MD 2.0 12.93). For 500 kg chlorine containers as used in swimming pools, no corresponding devices have been known hitherto. In an emergency, these containers must be recovered by recovery casks, which, however, are only present at a few support centers and are therefore not generally accessible in good time.

The sealing device for 50 kg chlorine containers consists of a base plate having three hooks for hanging from chains, a protective cap having a cylinder valve and sealing ring, and a clamping block to be attached over the protective cap and likewise having three hooks, in which the chains are hung.

However, such a device is not very suitable for 500 kg containers: on account of the high weight, accommodating the base plate is only possible with suitable measures and thus generally involves a considerable loss of time. Furthermore, the clamping block is only provided with a single clamping screw, a factor which does not appear sufficient for considerably larger containers.

The object of the invention was therefore to develop a sealing cap for larger gas containers, in particular 500 kg chlorine containers, which sealing cap can be fitted quickly, simply and reliably. It has to be taken into account in this case that the sealing cap must be attached by persons with protective equipment, in which case chlorine-resistant gloves have to be worn additionally over the normal safety gloves.

This object is achieved according to the invention in that a sealing cap which is equipped with at least two retaining claws is provided, and the retaining claws engage in the existing bead of the gas container. Preferred refinements of the invention are explained in more detail below:

The retaining claws are arranged uniformly on the outside of the sealing cap, that is to say opposite one another in the case of two retaining claws, at an angle of 120° from one another in the case of three retaining claws and at an angle of 90° from one another in the case of four retaining claws. There are preferably four retaining claws.

The retaining claws are connected to the sealing cap via a suitable device, for example by a chain or spring, but advantageously by a rod, which is arranged on the sealing cap in a hinged manner. Each rod is secured at the upper end thereof to the outside of the sealing cap by a hinged connection. Under practical conditions, the rigid rod facilitates the fitting of the cap. For reliable fastening, the rod is provided with a screw thread on the side opposite the retaining claw, so that firm seating of the retaining claw can be secured by a nut.

To provide a seal, an O-ring of an appropriate material, preferably of a fluoroelastomer, may be used in a manner known per se. The seal is advantageously guided in a groove of the seal cap, and the seal material is resistant to the gas within the container.

A pressure gage is expediently arranged in the top part of the sealing cap. A pressure of about 7 bar builds up at 20° C. and a pressure of about 10 bar already builds up at 30° C. The recovery team, if necessary, can thus take cooling measures.

Furthermore, the arrangement of a valve via which the discharging gas can be disposed of is expedient.

Furthermore, handles are expediently arranged on the sealing cap in order to facilitate the fitting.

The FIGURE shows an expedient design of the invention. In the FIGURE:

1=Sealing cap
2=Retaining claws
3=Rod for the retaining claws
4=Screw thread on the rod
5=Lock nut
6=Mount for the rod
7=Seal
8=Pressure gage
9=Pressure-gage valve
10=Discharge valve
11=Handle
12=Gas container
13=Gas container outlet
14=Gas container bead

What is claimed is:

1. A sealing cap for pressurized gas containers comprising a top wall, a cylindrical side wall connected to and downwardly extending from the top wall, and at least two releasable retaining elements on the outside of the side wall for securing the cap to a pressurized gas container, each releasable retaining element including an elongate rod with upper and lower opposite ends, a connection securing the upper end of each elongate rod to the outside of the cylindrical side wall, a claw at the lower end of each elongate rod, constructed and arranged to engage a pressurized gas container, and a screw thread and locking nut on the upper end of each elongate rod, and wherein the connection securing the upper end of each elongate rod to the outside of the cylindrical side wall comprises a hinged connection whereby the claw at the lower end of the elongate rod is movable toward and away from the cylindrical side wall.

2. The sealing cap as in claim 1 including a pressure gauge secured thereto.

3. The sealing cap as in claim 1 including a gas discharge valve secured thereto.

4. The sealing cap as in claim 1 including handles secured thereto on the outside of the cylindrical side wall.

5. The sealing cap as in claim 1 including an annular groove on the cylindrical side wall and a ring of sealing material in the groove for engaging a pressurized gas container.

6. The sealing cap as in claim 1 including four releasable retaining elements equally spaced apart on the outside of the cylindrical side wall.

7. The sealing cap as in claim 1 in combination with a pressurized gas container, the container having an outlet with an annular bead at the outlet, and wherein the sealing cap is fitted onto the container at the outlet and the claws of the releasable retaining elements engage under the annular bead.

8. The sealing cap and pressurized gas container combination of claim 7 wherein the container has a capacity of 500 kg of chlorine.

* * * * *

UNITED STATES PATENT AND TRADEMARK OFFICE

CERTIFICATE OF CORRECTION

PATENT NO. : 6,315,147 B1
DATED : November 13, 2001
INVENTOR(S) : Franz Bachmeier It is certified that error appears in the above-identified patent and that said Letters Patent is hereby corrected as shown below:

Title page,
Item [54], Title, delete "SEAL" and insert -- SEALING --.

Column 1,
Line 63, delete "seal" and insert -- sealing --.

Signed and Sealed this

Seventh Day of May, 2002

*Attest:*

*Attesting Officer*

JAMES E. ROGAN
*Director of the United States Patent and Trademark Office*